US005913299A

United States Patent [19]

Shimizu et al.

[11] Patent Number: 5,913,299

[45] Date of Patent: Jun. 22, 1999

[54] FUEL SUPPLY CONTROL SYSTEM FOR INTERNAL COMBUSTION ENGINES

[75] Inventors: Daisuke Shimizu; Norio Suzuki, both of Wako, Japan

[73] Assignee: Honda Giken Kogyo Kabushiki Kaisha, Tokyo, Japan

[21] Appl. No.: 08/906,998

[22] Filed: Aug. 6, 1997

[30] Foreign Application Priority Data

Aug. 6, 1996 [JP] Japan ..... 8-221833

[51] Int. Cl.[6] ..... F02D 41/04; F02D 41/06

[52] U.S. Cl. ..... 123/436; 60/285; 123/491

[58] Field of Search ..... 60/284, 285; 123/436, 123/491, 685, 686, 687

[56] References Cited

U.S. PATENT DOCUMENTS 3,789,816 2/1974 Taplin et al. ..... 123/436

5,715,796 2/1998 Suzuki et al. ..... 123/683 X 5,797,261 8/1998 Akazaki et al. ..... 123/674 X

FOREIGN PATENT DOCUMENTS 6-167210 6/1994 Japan .

6-63468 8/1994 Japan .

*Primary Examiner*—Tony M. Argenbright

*Attorney, Agent, or Firm*—Nikaido, Marmelstein, Murray & Oram LLP

[57] ABSTRACT

There is provided a fuel supply control system for an internal combustion engine installed on an automotive vehicle. The engine has an exhaust system, and an exhaust gas-purifying device arranged in the exhaust system. A start of the engine is detected. A combustion stability of the engine is detected. The air-fuel ratio of a mixture supplied to the engine is leaned over a predetermined time period from the start of the engine depending on the detected combustion stability.

15 Claims, 12 Drawing Sheets

FUEL INJECTION VALVE
INTERNAL COMBUSTION ENGINE
THREE-WAY CATALYST
O2
CYL
TDC
CRK
TW
TA
PBA
θTH
INPUT CIRCUIT
CPU
MEMORY DEVICE
OUTPUT CIRCUIT
ECU
V
GP
1
2
3
4
5
5a
5b
5c
5d
6
7
8
9
10
11
12
13
14
15
16
20
21

CALCULATION OF KCMD
S401
DURING FUEL CUT?
YES
NO
S408
KCMD←KCMDFC
S402
DURING WOT?
YES
NO
S403
IN AFTER-START LEAN-BURN CONTROL REGION?
YES
NO
S409
KCMD←KWOT
S410
EXECUTE AFTER-START LEAN-BURN CONTROL
S404
CALCULATE KBS
S405
KBS< KCMDTW ?
NO
YES
S406
KCMD←KCMDTW
S407
KCMD←KBS
S411
FLAFFB=1 ?
YES
NO
S412
KCMD← KCMD+KCMDREF
S413
LIMIT-CHECK KCMD
END

LIMIT-CHECKING OF KLSAF
DKLSAF←KOBJ(N) −KLSAF(N−1)
S31
S34
DKLSAF>0 ?
YES
NO
S35
KLASAF F/B CONTROL
S36
NE>NKSLB1 ?
NO
YES
S37
NE>NKSLB2 ?
YES
NO
S39
DKC1←DKC1M1M
S38
DKC1←DKC1M1L
S40
DKC1←DKC1M1H
S41
|DKLSAF| >DKC1 ?
NO
YES
KLSAF(N)← KLSAF(N−1)+DKC1
S42
FSLBFB←0
S43
S44
KLSAF(N) >1.0 ?
YES
NO
S45
KLSAF(N)←1.0
S46
KLSAF(N) <KLSAFL ?
YES
NO
S47
KLSAF(N)←KLSAFL
RETURN

FUEL SUPPLY CONTROL SYSTEM FOR INTERNAL COMBUSTION ENGINES

BACKGROUND OF THE INVENTION

1. Field of the Invention

This invention relates to a fuel supply control system for internal combustion engines, which controls the air-fuel ratio of a mixture supplied to the engine, and more particularly to a fuel supply control system of this kind, which controls the air-fuel ratio immediately after the start of the engine.

2. Prior Art

Conventionally, there has been proposed a method e.g. by Japanese Patent Publication (Kokoku) No. 6-63468, in which the air-fuel ratio of a mixture supplied to the engine is controlled to a leaner value than a stoichiometric air-fuel ratio (hereinafter referred to as "lean-burn control") until an exhaust gas-purifying device becomes active, or when the temperature of the engine is lower than a predetermined value, after the start of the engine, whereas after the exhaust gas-purifying device has been activated, or when the temperature of the engine exceeds the predetermined value, the air-fuel ratio is feedback-controlled to the stoichiometric air-fuel ratio. This method makes it possible to reduce emission of noxious components, particularly hydrocarbons (HC).

According to the above conventional method, however, when lean-burn control is carried out immediately after the engine is started in a cold state, if gasoline with low volatility is used as the fuel, the combustion state of the engine can become worse or unstable, causing degraded driveability of the engine. Therefore, it is required to set a lean-burn correction coefficient to a value considerably richer than a lean limit beyond which the air-fuel ratio is not permitted to be leaned, so as to avoid degradation of the driveability of the engine. This makes it impossible to improve exhaust emission characteristics of the engine, such as reduced emission of HC, to a satisfactory degree as intended by the lean burn control.

Further, when the engine is not equipped with means for feedback-controlling the air-fuel ratio to a leaner value than the stoichiometric air-fuel ratio, or when the air-fuel ratio sensor is in an inactive state and therefore open loop control of the air-fuel ratio has to be carried out, it is also required to set the lean-burn correction coefficient to such values as can accommodate differences in the combustion state between engines due to manufacturing tolerances of component parts of the engine between production lots and/or expected aging of the component parts, which causes the same problem as stated above.

Therefore, the conventional method still remains to be improved in the manner of lean-burn control to achieve satisfactory exhaust emission characteristics of the engine, such as reduced emission of HC.

SUMMARY OF THE INVENTION

It is an object of the invention to provide a fuel supply control system for an internal combustion engine, which is capable of performing the lean-burn control in an improved manner to achieve satisfactory enhanced exhaust emission characteristics of the engine without causing degradation of the driveability of the engine immediately after the start of the engine.

To attain the above object, the invention provides a fuel supply control system for an internal combustion engine installed on an automotive vehicle, the engine having an exhaust system, and an exhaust gas-purifying device arranged in the exhaust system.

The fuel supply control system according to the invention is characterized by comprising:

start-detecting means for detecting a start of the engine;

combustion stability-detecting means for detecting a combustion stability of the engine; and leaning means for leaning an air-fuel ratio of a mixture supplied to the engine over a predetermined time period from the start of the engine, depending on an output from the combustion stability-detecting means.

Preferably, the predetermined time period is a time period which elapses before the exhaust gas-purifying device is activated.

Preferably, the leaning means is inhibited from operating when the combustion stability detected by the combustion stability-detecting means indicates a combustion state in which a misfire occurs in the engine.

Preferably, the leaning means controls the air-fuel ratio of the mixture supplied to the engine in a manner such that the combustion stability detected by the combustion stability-detecting means becomes a predetermined combustion stability.

Preferably, the leaning means stores a value of the air-fuel ratio of the mixture supplied to the engine, which is assumed when the combustion stability of the engine is converged to the predetermined combustion stability, and controls the air-fuel ratio of the mixture supplied to the engine based on the stored value of the air-fuel ratio when the engine is started.

Preferably, the combustion stability-detecting means detects an amount of variation in rotational speed of the engine, and detects the combustion stability of the engine based on the detected amount of variation.

Preferably, the fuel supply control system includes means for detecting a temperature of the engine, and when the temperature of the engine is not within a predetermined range, the leaning means is inhibited from operating.

Preferably, the fuel supply control system includes operating condition-detecting means for detecting operating conditions of at least one of the engine and the automotive vehicle, the combustion stability-detecting means detecting a parameter indicative of a combustion state of the engine. The leaning means comprises:

first combustion state reference value-calculating means for calculating a first combustion state reference value based on the parameter indicative of the combustion state of the engine detected by the combustion state-detecting means;

second combustion state reference value-calculating means for calculating a second combustion state reference value depending on the operating conditions of the at least one of the engine and the automotive vehicle detected by the operating condition-detecting means;

comparison means for comparing the detected parameter indicative of the combustion state of the engine with the first combustion state reference value and the second combustion state reference value; and correction means for correcting the air-fuel ratio of the mixture supplied to the engine, based on results of the comparison by the comparison means.

More preferably, the parameter indicative of the combustion state of the engine is an amount of variation in rotational speed of the engine.

Also preferably, the first combustion state reference value is set based on an average value of the parameter indicative of the combustion state of the engine.

Preferably, the first combustion state reference value comprises a combustion-unstable side reference value set to such a value that when a degree of unstability of the combustion state of the engine indicated by the detected parameter exceeds the combustion-unstable side reference value, the combustion state of the engine can become unstable, and a combustion-stable side reference value set to a value higher in stability than the combustion-unstable side reference value.

Further preferably, the correction means corrects the air-fuel ratio of the mixture supplied to the engine in such a direction that the combustion state of the engine becomes stabilized, when the degree of unstability of the combustion state of the engine indicated by the detected parameter exceeds the combustion-unstable side reference value of the first combustion state reference value, while the correction means corrects the air-fuel ratio of the mixture supplied to the engine in such a direction that the engine has improved fuel economy, when the degree of unstability of the combustion state of the engine indicated by the detected parameter is below the combustion-stable side reference value of the first combustion state reference value.

Further preferably, the second combustion state reference value comprises a combustion-unstable side reference value set to such a value that when a degree of unstability of the combustion state of the engine indicated by the detected parameter exceeds the combustion-unstable side reference value of the second combustion state reference value, the combustion state of the engine can become unstable, and a combustion-stable side reference value set to value higher in stability than the combustion-unstable side reference value of the second combustion state reference value.

Still more preferably, the second combustion state reference value comprises a combustion-unstable side reference value set to such a value that when a degree of unstability of the combustion state of the engine indicated by the detected parameter exceeds the combustion-unstable side reference value of the second combustion state reference value, the combustion state of the engine can become unstable, and a combustion-stable side reference value set to a value higher in stability than the combustion-unstable side reference value of the second combustion state reference value, and when the degree of unstability of the combustion state of the engine indicated by the detected parameter exceeds the combustion-unstable side reference value of the second combustion state reference value, the correction means corrects the air-fuel ratio of the mixture supplied to the engine by the use of a first correction amount in such a direction that the combustion state of the engine becomes stabilized when the degree of unstability of the combustion state of the engine indicated by the detected parameter exceeds the combustion-unstable side reference value of the first combustion state reference value, while the correction means corrects the air-fuel ratio of the mixture supplied to the engine by the use of a second correction amount smaller than the first correction amount in such a direction that the combustion state of the engine becomes stabilized when the degree of unstability of the combustion state of the engine indicated by the detected parameter is below the combustion-unstable side reference value of the first combustion state reference value.

More preferably, the second combustion state reference value comprises a combustion-unstable side reference value set to such a value that when a degree of unstability of the combustion state of the engine indicated by the detected parameter exceeds the combustion-unstable side reference value of the second combustion state reference value, the combustion state of the engine can become unstable, and a combustion-stable side reference value set to a value higher in stability than the combustion-unstable side reference value of the second combustion state reference value, and when the degree of unstability of the combustion state of the engine indicated by the detected parameter is below the combustion-stable side reference value of the second combustion state reference value, the correction means corrects the air-fuel ratio of the mixture supplied to the engine by the use of a first correction amount in such a direction that the engine has improved fuel economy when the degree of unstability of the combustion state of the engine indicated by the detected parameter exceeds the combustion-stable side reference value of the first combustion state reference value, while the correction means corrects the air-fuel ratio of the mixture supplied to the engine by the use of a second correction amount larger than the first correction amount in such a direction that the engine has improved fuel economy when the degree of unstability of the combustion state of the engine indicated by the detected parameter is below the combustion-stable side reference value of the first combustion state reference value.

The above and other objects, features, and advantages of the invention will become more apparent from the following detailed description taken in conjunction with the accompanying drawings.

BRIEF DESCRIPTION OF THE DRAWINGS

FIGS. 2A and 2B are flowcharts showing routines for detecting a variation amount DMSSLB of the rotational speed the engine, in which:

FIG. 2A is a flowchart showing a routine for carrying out a CRK process; and FIG. 2B is a flowchart showing a routine for carrying out a #3STG process;

FIGS. 11A and 11B show tables for determining second threshold values MSLEAN1 and MSLEAN2, in which:

FIG. 11A shows a table for determining the second threshold values according to the engine rotational speed NE; and FIG. 11B shows a table for determining the second threshold values according to intake pipe absolute pressure PBA; and FIGS. 12A and 12B are diagrams useful in explaining the relationship between the rotational speed variation amount DMSSLB and the lean-burn correction coefficient KLSAF, in which:

FIG. 12A shows changes in the lean-burn correction coefficient KLSAF; and

FIG. 12B shows changes in the rotational speed variation amount DMSSLB.

DETAILED DESCRIPTION

The invention will now be described in detail with reference to the drawings showing an embodiment thereof.

Figure 1:
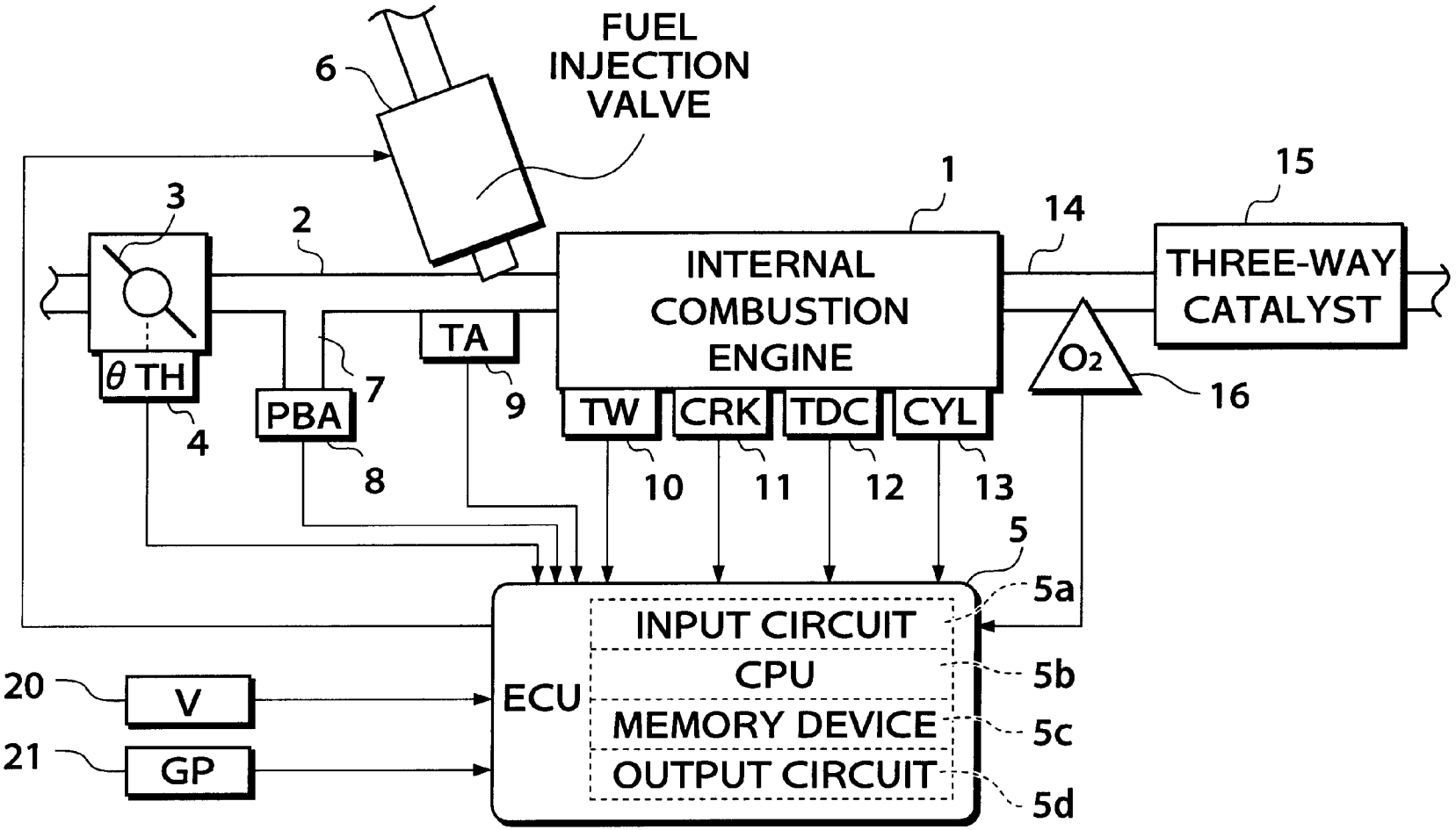
FIG. 1 is a block diagram showing the whole arrangement of an internal combustion engine incorporating a fuel supply control system according to an embodiment of the invention.

Referring first to FIG. 1, there is shown the whole arrangement of an internal combustion engine incorporating a fuel supply control system therefor, according to an embodiment of the invention. In the figure, reference numeral 1 designates an internal combustion engine (hereinafter referred to as "the engine"), which has an intake pipe 2 connected to the cylinder block of the engine 1, in which is arranged a throttle valve 3. A throttle valve opening (θ TH) sensor 4 is connected to the throttle valve 3, for generating an electric signal indicative of the sensed throttle valve opening (θ TH) and supplying the same to an electronic control unit (hereinafter referred to as "the ECU 5").

Fuel injection valves 6, only one of which is shown, are inserted into the intake pipe 2 at locations intermediate between the throttle valve 3 and the cylinder block of the engine 1 and slightly upstream of respective intake valves, not shown. The fuel injection valves 6 are connected to a fuel pump, not shown, and electrically connected to the ECU 5 to have their valve opening periods controlled by signals therefrom.

On the other hand, an intake pipe absolute pressure (PBA) sensor 8 is provided in communication with the interior of the intake pipe 2 via a conduit 7 opening into the intake pipe 2 at a location immediately downstream of the throttle valve 3, for supplying an electric signal indicative of the sensed absolute pressure PBA within the intake pipe 2 to the ECU 5. An intake air temperature (TA) sensor 9 is inserted into the intake pipe 2 at a location downstream of the PBA sensor 8, for supplying an electric signal indicative of the sensed intake air temperature TA to the ECU 5.

An engine coolant temperature (TW) sensor 10, which may be formed of a thermistor or the like, is mounted in the cylinder block of the engine 1, for supplying an electric signal indicative of the sensed engine coolant temperature TW to the ECU 5.

Arranged in facing relation to a camshaft or a crankshaft of the engine 1, neither of which is shown, are a cylinder-discriminating sensor (hereinafter referred to as "the CYL sensor") 13 which generates a pulse (hereinafter referred to as "the CYL signal pulse") at a predetermined crank angle position of a particular cylinder of the engine, a TDC sensor 12 which generates a pulse (hereinafter referred to as "the TDC signal pulse") at a predetermined crank angle position of each cylinder a predetermined angle before a TDC position corresponding to the start of the intake stroke of the cylinder whenever the crankshaft rotates through 180 degrees in the case of a four-cylinder engine), and a crank angle sensor (hereinafter referred to as "the CRK sensor") 11 which generates a pulse (hereinafter referred to as "the CRK signal pulse") at each of predetermined crank angle positions whenever the crank shaft rotates through a predetermined angle (e.g. 30 degrees) smaller than the rotational angle of generation of the TDC signal pulse. The CYL signal pulse, the TDC signal pulse, and the CRK signal pulse are supplied to the ECU 5.

A three-way catalyst 15 as an exhaust gas-purifying device is arranged within an exhaust pipe 14 connected to the cylinder block of the engine 1, for purifying noxious components such as HC, CO, and NOx. A LAF sensor (linear linear-output oxygen concentration sensor) 16 is arranged within the exhaust pipe 14 at a location upstream of the three-way catalyst 15, for supplying the ECU 5 with an electric signal almost proportional in value to the concentration of oxygen in exhaust gases emitted from the engine 1.

Further connected to the ECU 5 are a vehicle speed (V) sensor 20 for detecting the traveling speed V of an automotive vehicle on which the engine 1 is installed, a gear ratio sensor 21 for detecting a gear ratio (shift position) of a transmission of the vehicle, etc., for supplying respective signals indicative of the detected parameters to the ECU 5. Alternatively, the gear ratio may be detected based on the vehicle speed V and the engine rotational speed NE.

The ECU 5 is comprised of an input circuit 5*a* having the functions of shaping the waveforms of input signals from various sensors including ones mentioned above, shifting the voltage levels of sensor output signals to a predetermined level, converting analog signals from analog-output sensors to digital signals, and so forth, a central processing unit (hereinafter referred to as "the CPU") 5*b*, a memory device 5*c* storing various operational programs which are executed by the CPU 5*b*, and for storing results of calculations therefrom, etc., and an output circuit 5*d* which outputs driving signals to the fuel injection valves 6.

The CPU 5*b* operates in response to the above-mentioned signals from the sensors to determine various operating conditions in which the engine 1 is operating, such as an air-fuel ratio feedback control region in which the air-fuel ratio of a mixture supplied to the engine 1 is controlled in response to the detected oxygen concentration in the exhaust gases, and open-loop control regions other than the air-fuel ratio feedback control region, and calculates, based upon the determined operating conditions, the valve opening period or fuel injection period TOUT over which the fuel injection valves 6 are to be opened, by the use of the following equation (1) when the engine 1 is in a basic mode or by the use of the following equation (2) when the engine is in a starting mode, in synchronism with inputting of TDC signal pulses to the ECU 5:

$$TOUT = Tim \times KCMD \times K1 + K2 \quad (1)$$

$$TOUT = TiCR \times (KLSAFREF / KLSAFBASE) \times K3 + K4 \quad (2)$$

where Tim represents a basic fuel amount or basic fuel injection period suitable for use when the engine is in the basic mode, which is determined in accordance with the engine rotational speed NE and the intake pipe absolute pressure PBA. A Tim map for determining the Tim value is stored in the memory device 5*c*.

TiCR represents a basic fuel amount or basic fuel injection period suitable for use when the engine is in the starting mode. Similarly to the Tim value, the TiCR value is determined according to the engine rotational speed NE and the intake pipe absolute pressure PBA, and a TiCR map for determining the TiCR value is stored in the memory device 5*c*.

KCMD represents a desired air-fuel ratio coefficient which is calculated based on operating conditions of the engine.

This coefficient KCMD is also applied during lean-burn control including after-start lean-burn control, wherein a lean-burn correction coefficient KLSAF as part of lean control means is reflected on the desired air-fuel ratio coefficient KCMD. The KLSAF value is set to a value smaller than "1.0" when the engine and the vehicle are in respective predetermined operating conditions, as will be described hereinafter.

KLSAFREF represents a learned value of the lean-burn correction coefficient KLSAF which is calculated in a KLSAF feedback control process described hereinafter with reference to FIGS. 9 and 10. KLSAFBASE represents a value to which the KLSAFREF value is supposed to be converged when the engine 1 is in a normal operating condition. The KLSAFBASE value is set to e.g. "0.9".

K1, K2, K3 and K4 represent other correction coefficients and correction variables, which are set according to engine operating parameters to such values as optimize operating characteristics of the engine, such as fuel consumption and engine accelerability.

Figure 2A:
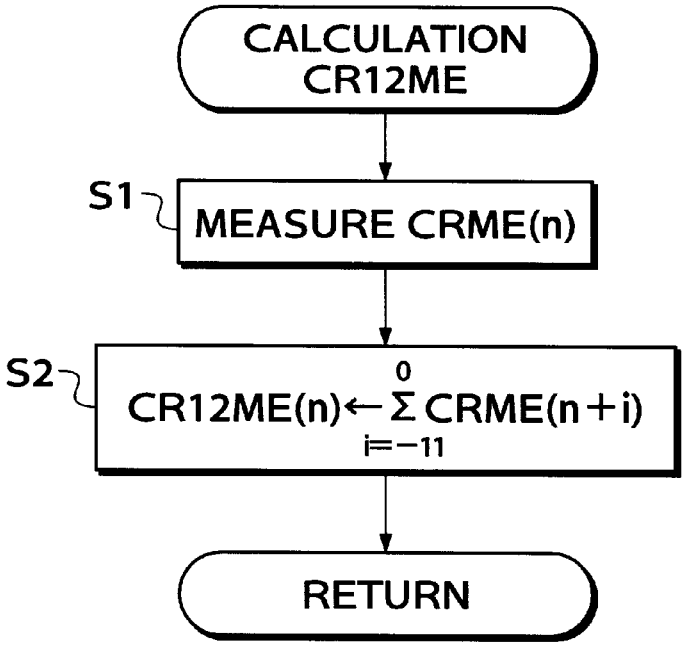
Figure 2B:
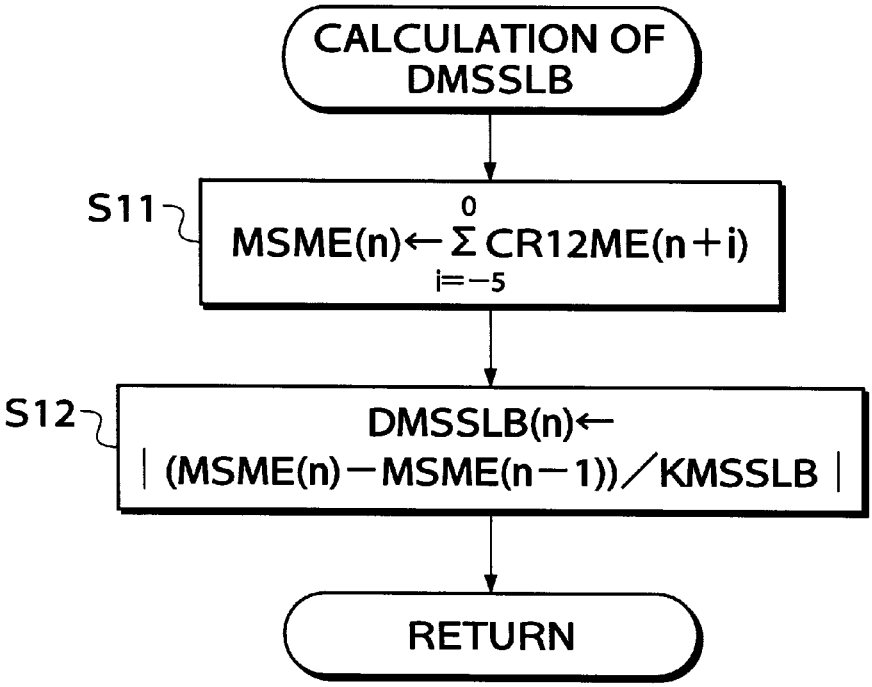

FIGS. 2A and 2B show routines for calculating a variation amount DMSSLB in the rotational speed of the engine for use in calculating the lean-burn correction coefficient KLSAF, which are executed by the CPU 5*b*. The rotational speed variation amount DMSSLB is indicative of a degree of stability of the combustion state of the engine 1.

Figure 3:
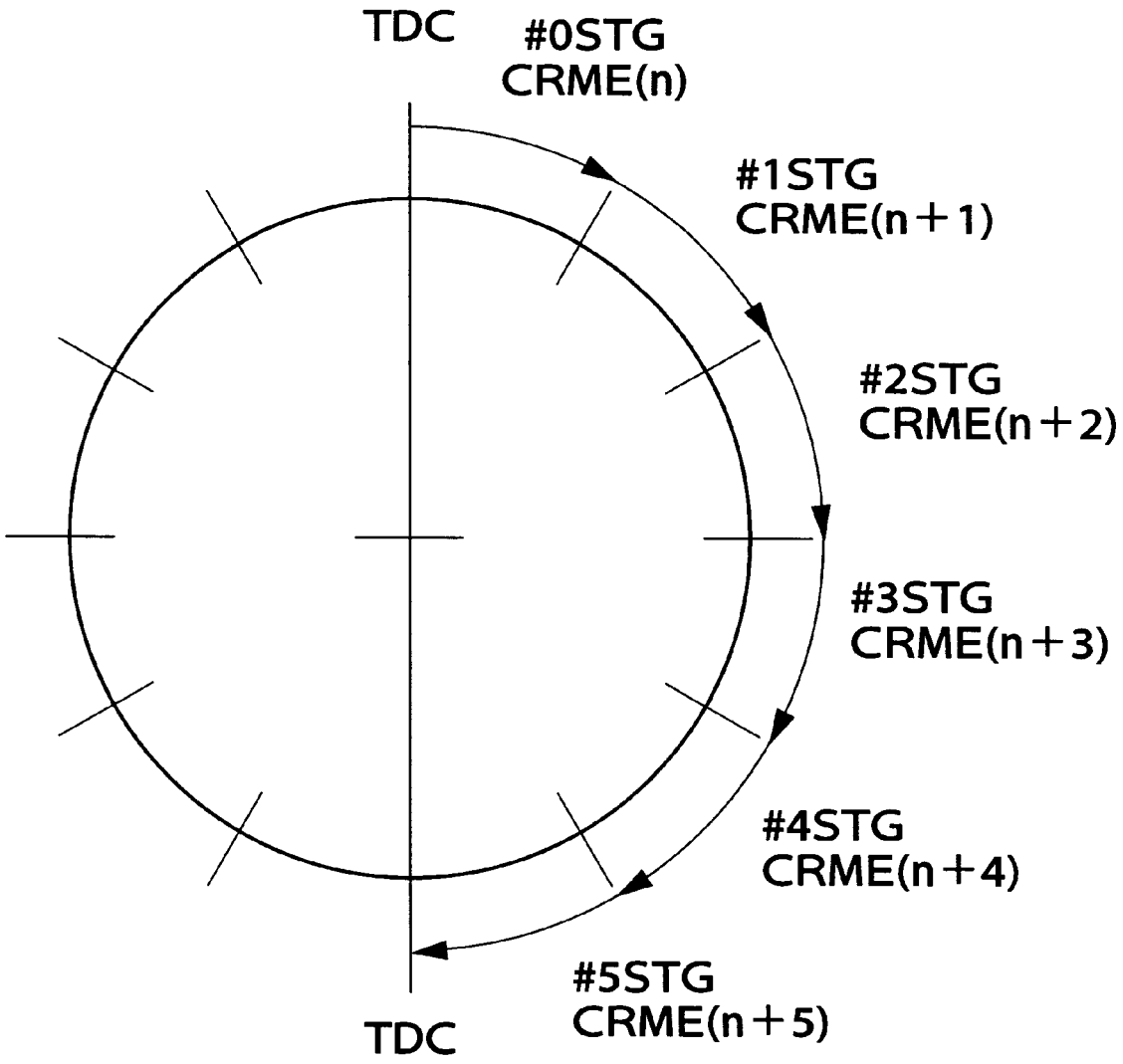
FIG. 3 is a diagram which is useful in explaining a manner of measuring a parameter indicative of the rotational speed of the engine with respect to the rotational angle of a crankshaft of the engine.

FIG. 2A shows a routine for carrying out a CRK process which is executed in synchronism with generation of each CRK signal pulse. First, at a step S1, time intervals of generation of CRK signal pulses (i.e. a parameter proportional to the reciprocal of the engine rotational speed) are calculated. More specifically, a time interval value CRME (n) is successively measured whenever the crankshaft rotates through 30 degrees, as shown in FIG. 3. The new measured value CRME(n) updates the immediately preceding value, and the preceding values are stored as CRME(n−1), CRME (n−2) . . . .

In this connection, the repetition period of rotation of the crankshaft through 180 degrees is divided into #0 to #5 stages (#0STG to #5STG) each corresponding to each time period of rotation of the crankshaft through 30 degrees.

At a step S2, a first average value CR12ME(n) is calculated by averaging twelve CRME values from the value CRME(n−11) measured eleven loops before the present loop to a value CRME(n) in the present loop, by the use of the following equation (3):

$$CR12ME(n) = \sum_{i=-11}^{0} CRME(n+i) \tag{3}$$

In the present embodiment, since CRK signal pulses are each generated whenever the crankshaft rotates through 30 degrees, the first average value CR12ME(n) is obtained over one rotation of the crankshaft. The first average value CRME(n) obtained by such averaging every period of one rotation of the crankshaft is free of the influence of n-th order vibration components (n=1, 2, 3 . . . ) of engine rotation over a repetition period thereof which corresponds to one rotation of the crankshaft, i.e. noise components due to dimensional errors (such as manufacturing tolerances and mounting tolerances) of a pulser or a pickup forming the crank angle sensor 11.

The engine rotational speed NE is also calculated based on the CRME(n) value.

FIG. 2B shows a routine for carrying out a #3STG process, which is executed at a #3STG (#3 stage of FIG. 3) with the same repetition period as the repetition period of generation of TDC signal pulses. First, at a step S11, a second average value MSME(n) is calculated by averaging six CR12ME values from a value CR12ME(n−5) obtained five loops before the present loop to a value CR12ME(n) in the present-loop, by the use of the following equation (4):

$$MSME(n) = \sum_{i=-5}^{0} CRME(n+i) \tag{4}$$

In the present embodiment, the engine 1 is a 4-cylinder type/4-cycle engine, wherein spark ignition is carried out at any one of the cylinders whenever the crankshaft rotates through 180 degrees. Therefore, the second average value MSME(n) is obtained from the first average value CR12ME (n) over one firing period. The average value thus obtained is representative of a central value of values of the engine rotational speed assumed between the last engine combustion and the present engine combustion.

Then, the rotational speed variation amount DMSSLB(n) is calculated by the use of the following equation (5):

$$DMSSLB(n) = |(MSME(n) - MSME(n-1)/KDMSSLB \tag{5}$$

where KMSSLB represents a coefficient which is set to a value inversely proportional to the engine rotational speed NE so as to prevent the calculated rotational speed variation amount DMSSLB from varying with the engine rotational speed NE, whereby the accuracy of lean-burn control is maintained constant irrespective of the engine rotational speed NE.

The rotational speed variation amount DMSSLB thus calculated tends to increase as the combustion state of the engine becomes worse, and hence can be used as a parameter indicative of the combustion state of the engine. In general, as the air-fuel ratio is set to leaner values, the combustion state of the engine progressively becomes unstable and accordingly the DMSSLB value increases. FIG. 12B shows, by way of example, an irregular combustion state of the engine which takes place when the air-fuel ratio is controlled to a lean limit or a close value thereto. This irregular combustion state is characterized by spikes of the DMSSLB value occurring every several seconds, as shown in the figure. If the air-fuel ratio is further leaned beyond this limit, the engine enters an unstable combustion state in which surging of the engine rotational speed can be sensed by the driver through vibrations transmitted to his body from the engine. Therefore, it is preferable that the air-fuel ratio should be controlled to the above lean limit at most as will cause an irregular combustion state as shown in FIG. 12B or a value slightly richer than the lean limit so as to maintain a stable combustion state of the engine.

Figure 4:
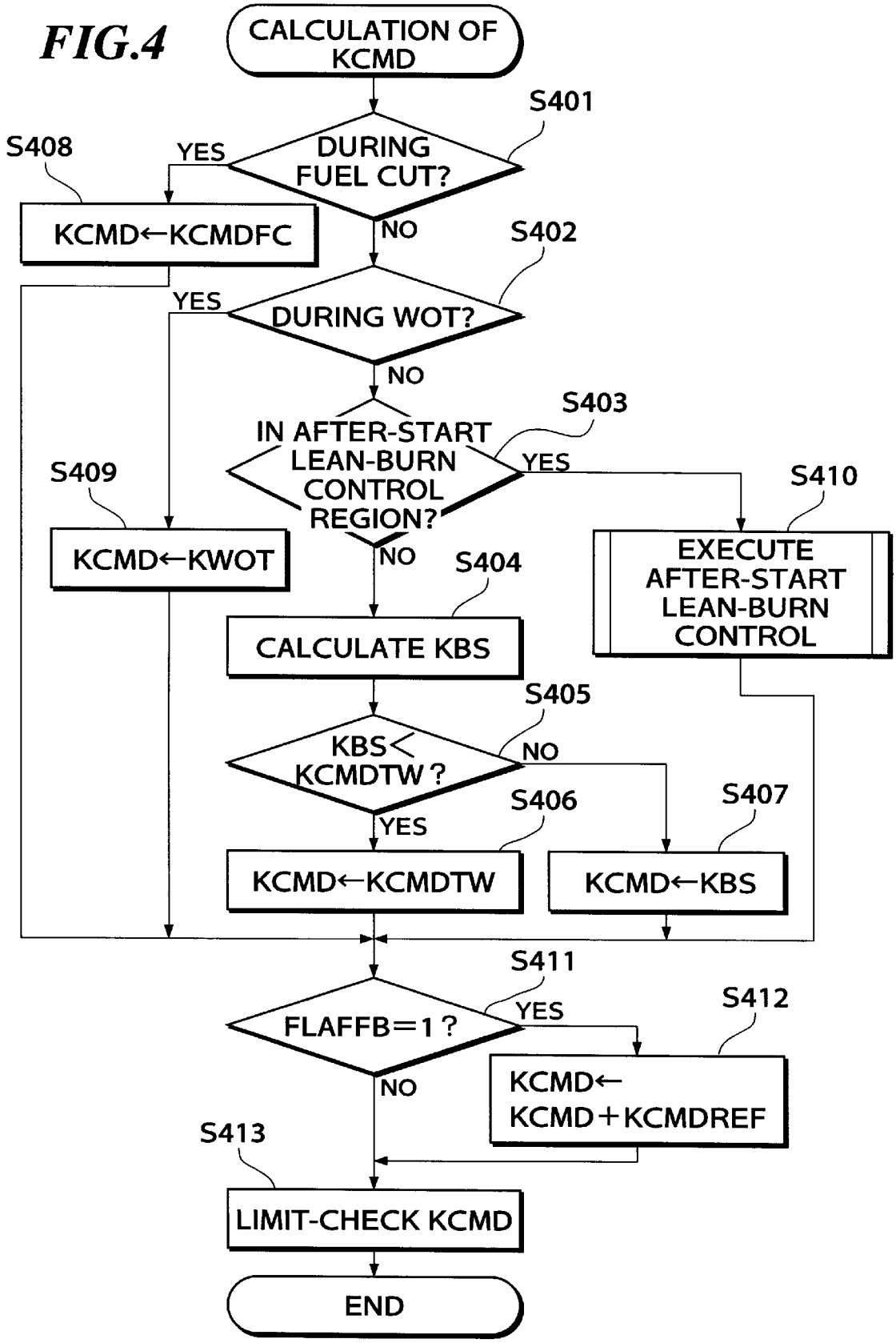
FIG. 4 is a flowchart showing a main routine for calculating a desired air-fuel ratio coefficient KCMD.

FIG. 4 shows a routine for calculating the desired air-fuel ratio coefficient KCMD, which is executed by the CPU 5*b* in synchronism with generation of each TDC signal pulse.

Figure 5:
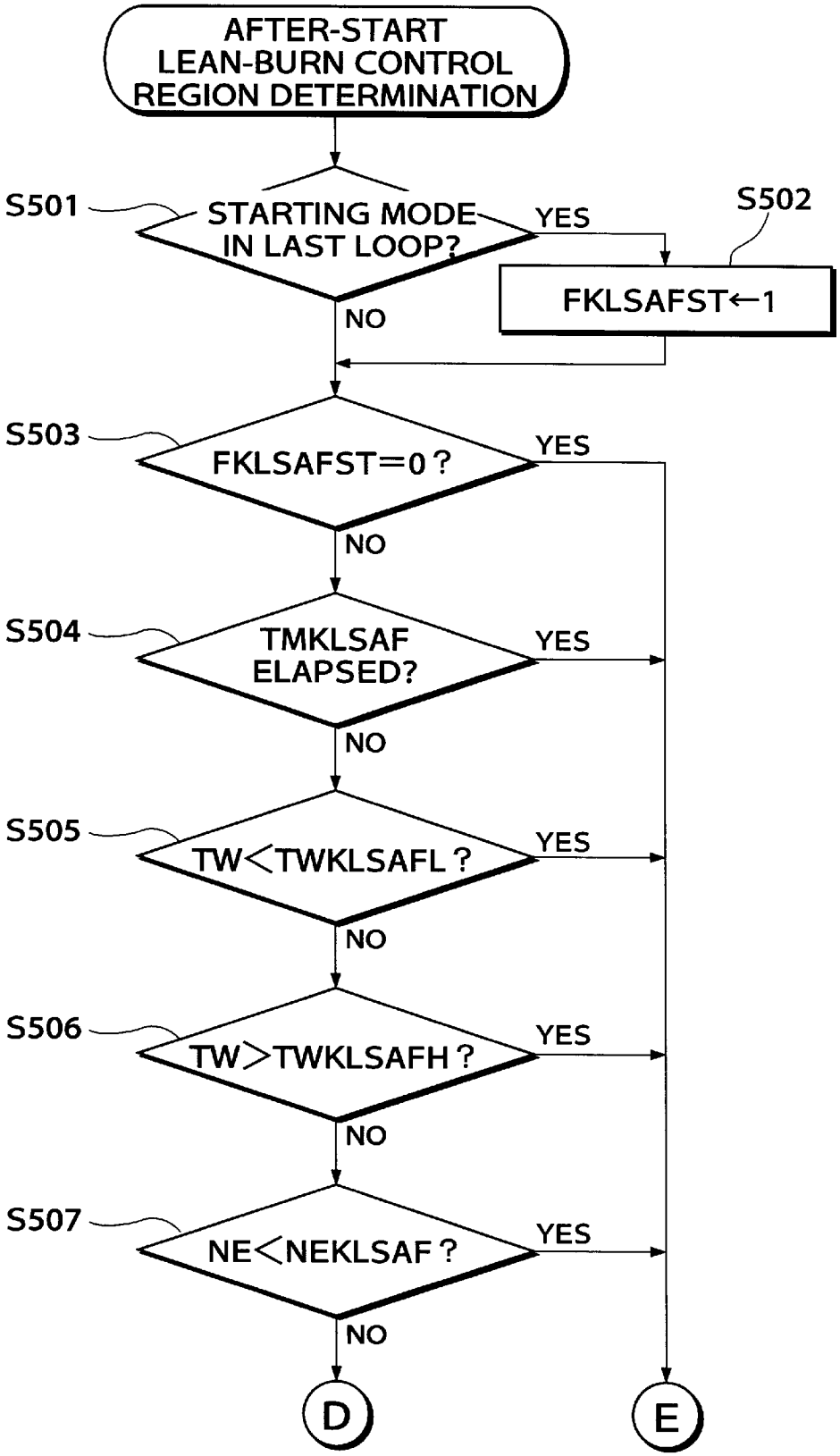
FIG. 5 is a flowchart showing a subroutine for determining an after-start lean-burn control region, which is executed at a step S403 in FIG. 4.
Figure 6:
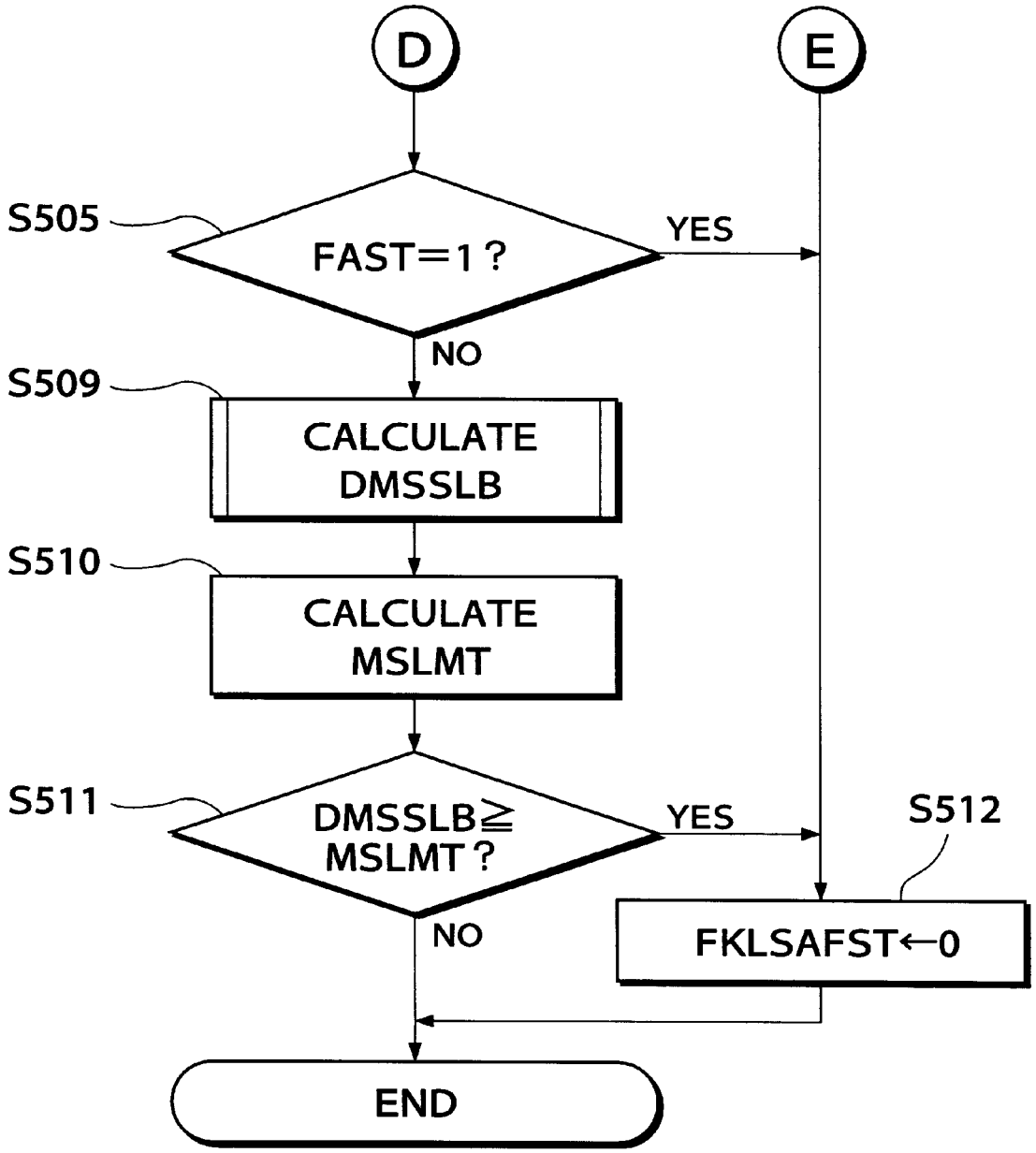
FIG. 6 is a continued part of the FIG. 5 flowchart.

First, at a step S401, it is determined whether or not fuel cut is being carried out. If fuel cut is not being carried out, it is determined at a step S402 whether or not the engine 1 is in a WOT (wide-open-throttle) region. If the engine 1 is not in the WOT region, a subroutine shown in FIGS. 5 and 6 is executed at a step S403 to determine whether or not the engine 1 is in a control region in which lean-burn control immediately after the start of the engine is to be carried out (hereinafter referred to as "the after-start lean-burn control region"). If the engine 1 is not in the after-start lean-burn control region, a basic value KBS is determined at a step S404 by retrieving a KBS map according to the engine rotational speed NE and the intake pipe absolute pressure PBA, and then the program proceeds to a step S405, wherein it is determined whether or not KBS<KCMDTW holds. KCMDTW represents a desired value of the coefficient KCMD suitable for a low coolant temperature condition, which is obtained by retrieving a table set such that the KCMDTW value becomes smaller as the engine coolant temperature is higher. If KBS<KCMDTW holds at the step S405, the desired air-fuel ratio coefficient KCMD is set to the desired value KCMDTW at a step S406, followed by the program proceeding to a step S411. If fuel cut is being carried out at the step S401, the desired air-fuel ratio coefficient KCMD is set to a predetermined value KCMDFC at a step S408, followed by the program proceeding to the step S411.

If the engine 1 is in the WOT region at the step S402, the desired air-fuel ratio coefficient KCMD is set to a predetermined value KWOT at a step S409, followed by the program proceeding to the step S411.

If the engine 1 is in the after-start lean-burn control region, after-start lean-burn control is carried out at a step S410 by a subroutine shown in FIG. 7, described hereinafter, followed by the program proceeding to the step S411.

If KBS ≧KCMDTW holds at the step S405, the desired air-fuel ratio coefficient KCMD is set to the basic value KBS at a step S407, followed by the program proceeding to the step S411.

At the step S411, it is determined whether or not a flag FLAFFB, which, when set to "1", indicates that feedback control of the LAF sensor 16 is being carried out, assumes "1". If FLAFFB=1 holds, a learned air-fuel ratio correction coefficient KCMDREF, which was calculated by a routine, not shown, during normal air-fuel ratio feedback control in a steady operating condition of the engine, is added to the KCMD value to thereby obtain an updated value of the desired air-fuel ratio coefficient KCMD at a step S412, followed by the program proceeding to a step S413, whereas if FLAFFB=0 holds, the program immediately proceeds to the step S413. At the step S413, limit-checking of the KCMD value is carried out, followed by terminating the program.

FIGS. 5 and 6 show the subroutine for determining the after-start lean-burn control region, which is executed by the CPU 5*b* in synchronism with generation.of each TDC signal pulse.

First, at a step S501, it is determined whether or not the engine 1 was in the starting mode in the last loop, by determining whether or not the engine 1 was being cranked in the last loop. If the engine 1 was in the starting mode in the last loop, an after-start leaning flag FKLSAFST, which, when set to "1", indicates that the engine 1 is in the after-start lean-burn control region, is set to "1" at a step S502, followed by the program proceeding to a step S503, whereas if the engine 1 was not in the starting mode in the last loop, the program immediately proceeds to the step S503.

At the step S503, it is determined whether or not the flag FKLSAFST is set to "0". If the flag FKLSAFST is set to "1", it is determined at a step S504 whether or not a predetermined time period TMKLSAF has elapsed after the start of the engine 1. The predetermined time period TMKLSAF is set to e.g. a sufficient time period (e.g. approximately 20 seconds) for the three-way catalyst 15 to become active. If the predetermined time period TMKLSAF has not elapsed at the step S504, it is determined at a step S505 whether or not the engine coolant temperature TW is lower than a lower limit value TWKLSAFL (e.g. −10° C.). If TW≧TWKLSAFL holds, it is determined at a step S506 whether or not the engine coolant temperature TW is higher than an upper limit value TWKLSAFH (e.g. 80° C.). If TW≦TWKLSAFH holds, it is determined at a step S507 whether or not the engine rotational speed NE is lower than a predetermined value NEKLSAF which is set according to the engine coolant temperature TW to a lower value than a desired idling rotational speed. If NE≧NEKLSAF holds, it is determined at a step S508 whether or not an after-start-determining flag FAST, which, when set to "1", indicates that the engine 1 is in an after-start condition (i.e. a predetermined time period has elapsed after the engine 1 shifted to the basic mode, or the vehicle has started traveling), is set to "1". If the flag FAST assumes "0", the program proceeds to a step S509.

Thus, only when all the answers to the questions of the steps S503 to S508 are negative (NO), the program proceeds to the step S509, whereas when any one of the answers is affirmative (YES), the program proceeds to a step S512.

At the step S509, the rotational speed variation amount DMSSLB is calculated by the FIG. 2 subroutine, described hereinbefore, and then, at a step S510, a misfire-determining threshold value MSLMT is calculated for determining stability of the engine combustion state (i.e. whether or not a misfire has occurred in the engine 1). The threshold value MSLMT is set according to operating conditions of the engine 1 to a larger value than an upper threshold value MSLEAN2 which is set by a process, described hereinafter.

Then, at a step S511, it is determined whether or not DMSSLB≧MSLMT holds. If DMSSLB<MSLMT holds, the program is immediately terminated, whereas if DMSSLB≧MSLMT holds, it is judged that a misfire has occurred, and the program proceeds to a step S512 so as to stop the air-fuel ratio from being leaned. At the step S512, the after-start leaning flag FKLSAFST is set to "0", followed by terminating the program.

Figure 7:
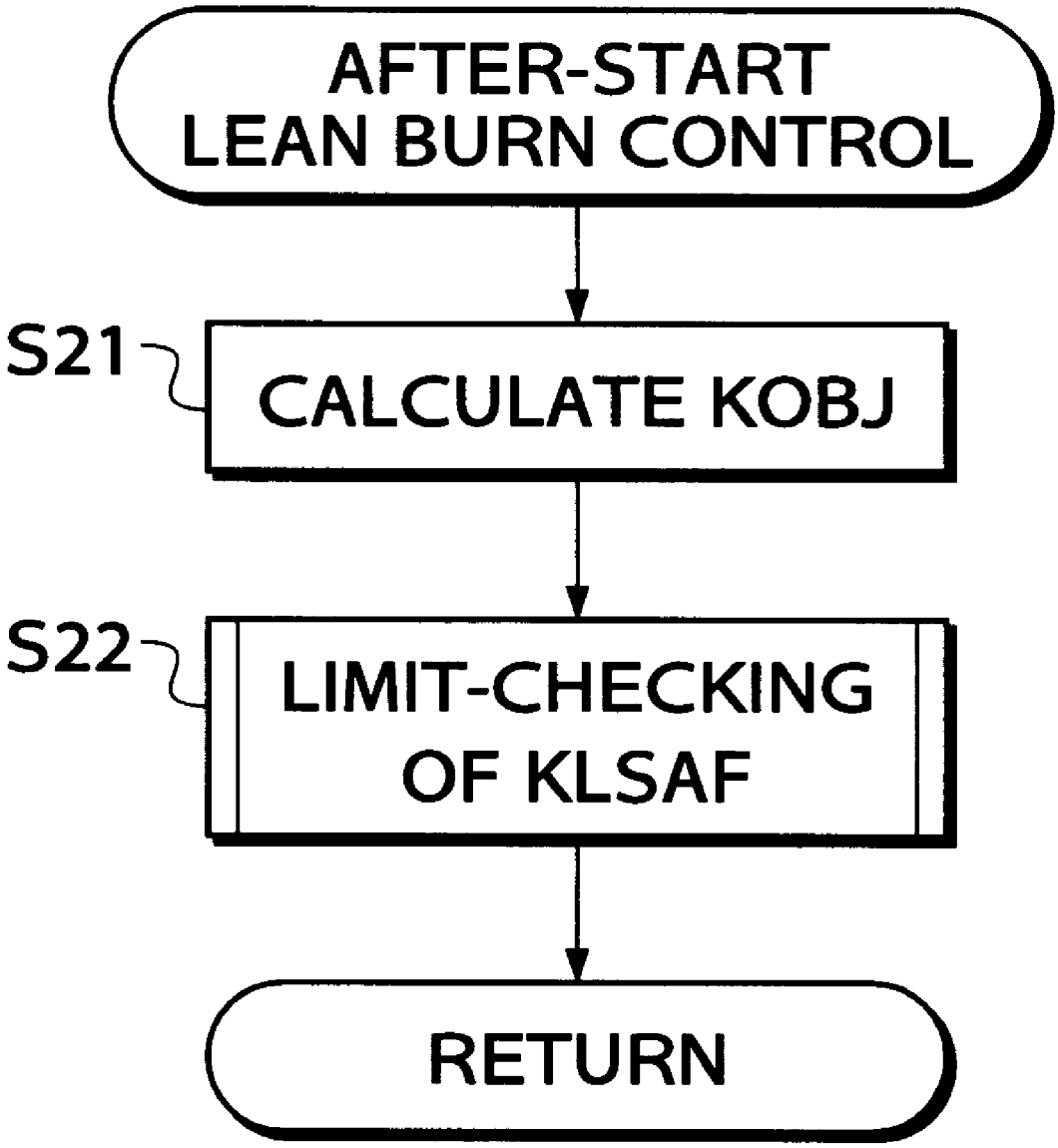
FIG. 7 is a flowchart showing a subroutine for carrying out after-start lean-burn control, which is executed at a step S410 in FIG. 4.

FIG. 7 shows the subroutine for carrying out the after-start lean-burn control, which is executed at the step S410 in FIG. 4 in synchronism with generation of each TDC signal pulse.

First, at a step S21, a desired air-fuel ratio (desired equivalent ratio) KOBJ is calculated by a routine, not shown. The desired air-fuel ratio KOBJ is calculated based on the engine coolant temperature TW, the gear ratio of the transmission, the vehicle speed V, the throttle valve opening θ TH, the engine rotational speed NE, the intake pipe absolute pressure PBA, etc., to a value smaller than 1.0 for leaning of the air-fuel ratio when the engine is in such an operating condition as permits execution of the after-start lean-burn control, e.g. when the throttle valve opening θ TH is smaller than a predetermined value, and to 1.0 when the engine is operating in a condition other than the above condition. The desired air-fuel ratio KOBJ is set to the present value KLSAF(N) when the latter is updated by routines shown in FIGS. 8 to 10.

At the following step S22, limit-checking of the lean-burn correction coefficient KLSAF, described below, is carried out.

Figure 8:
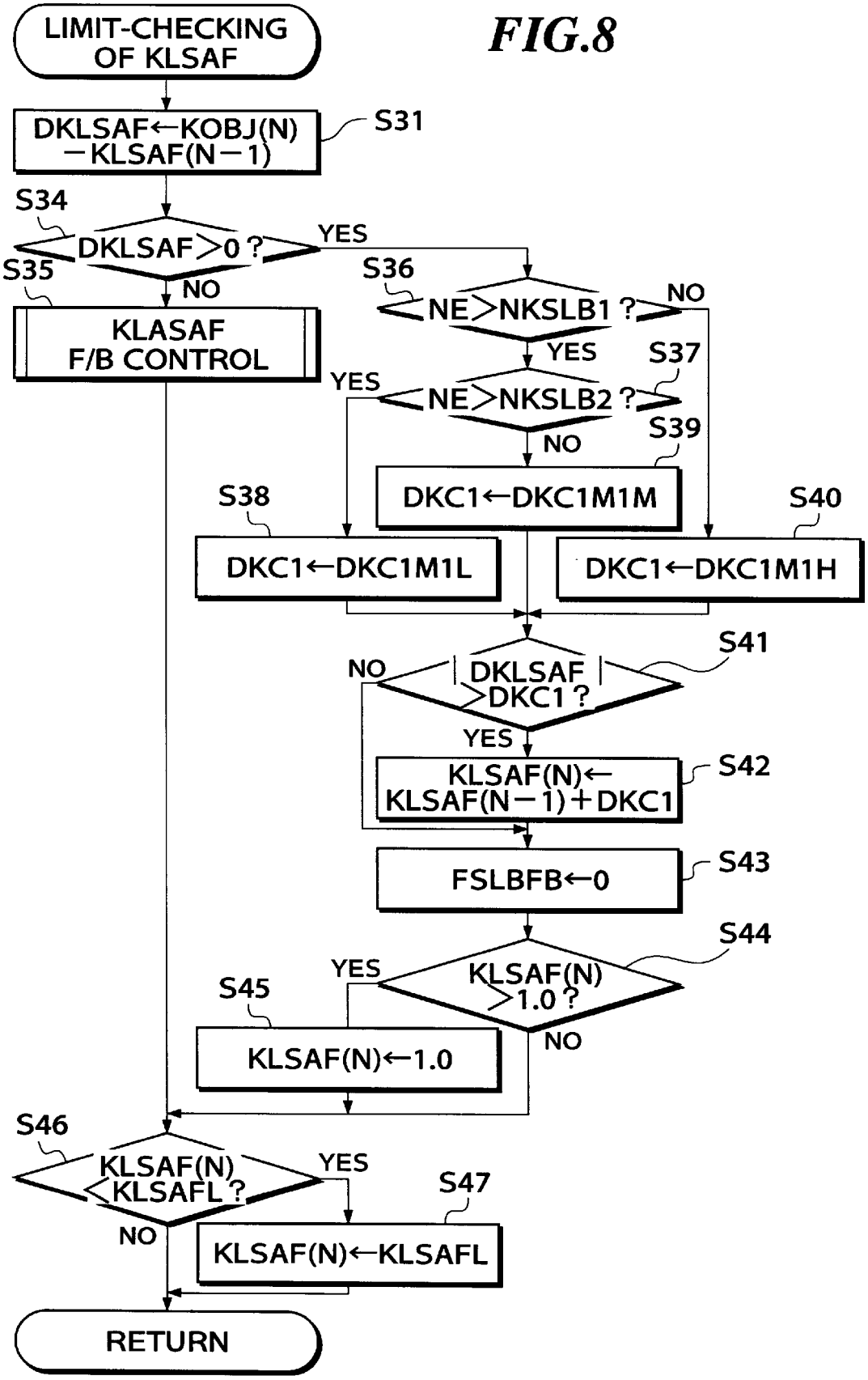
FIG. 8 is a flowchart showing a subroutine for limit-checking a lean-burn correction coefficient KLSAF, which is executed at a step S22 in FIG. 7.

FIG. 8 shows a subroutine for carrying out the limit-checking of the lean-burn correction coefficient KLSAF.

First, at a step S31, an amount of change DKLSAF is calculated as the difference between the present desired air-fuel ratio value KOBJ(N) and the immediately preceding value KLSAF(N−1) of the lean-burn correction coefficient KLSAF by the use of the following equation (6):

$$DKLSAF=KOBJ(N)-KLSAF(N-1) \quad (6)$$

The DKLSAF value is also used to determine whether the air-fuel ratio is being corrected in an enriching direction or in a leaning direction in the present loop.

Then, it is determined at a step S34 whether or not the amount of change DKLSAF calculated at the step S31 assumes a positive value. If the answer to the question is affirmative (YES), which means that the KLSAF value directly set to the KOBJ value has increased, it is determined at a step S36 whether or not the engine rotational speed NE is higher than a first predetermined NE value NKSLB1. If NE≦NKSLB1 holds, an addend term DKC1 is set to a predetermined value DKC1M1H suitable for a low NE region at a step S40, followed by the program proceeding to a step S41.

If NE>NKSLB1 holds at the step S36, it is further determined at a step S37 whether or not the engine rotational speed NE is higher than a second predetermined NE value NKSLB2 which is higher than the first predetermined NE value NKSLB1. If NE≦NKSLB2 holds, the addend term DKC1 is set to a predetermined value DKC1M1M suitable for a medium NE region at a step S39, whereas if NE>NKSLB2 holds, the addend term DKC1 is set to a predetermined value DKC1M1L suitable for a high NE region at a step S38, and then the program proceeds to the step S41. These predetermined values are in the relationship of DKC1M1H>DKC1M1M>DKC1M1L.

At the step S41, it is determined whether or not the absolute value of the amount of change DKLSAF calculated at the step S31 is larger than the addend term DKC1. If |DKLSAF|≦DKC1 holds, the program jumps to a step S43, whereas if |DKLSAF|>DKC1 holds, the program proceeds to a step S42, wherein the present value KLSAF(N) is calculated by the use of the following equation (7):

$$KLSAF(N)=KLSAF(N-1)+DKC1 \tag{7}$$

Then, at the step S43, a lean feedback flag FSLBFB, which, when set to "1", indicates that the lean-burn correction coefficient KLSAF is to be set according to the rotational speed variation amount DMSSLB (i.e. feedback control of the lean-burn correction coefficient KLSAF is to be carried out), is set to "0", and then the program proceeds to a step S44, wherein it is determined whether or not the present value KLSAF(N) is larger than "1.0". If KLSAF(N) ≦1.0 holds, the program jumps to a step S46, whereas if KLSAF(N)>1.0 holds, the present value KLSAF(N) is set to "1.0" at a step S45, and then the program proceeds to the step S46.

At the step S46, it is determined whether or not the present value KLSAF(N) is smaller than a predetermined lower limit value KLSAFL. If KLSAF(N)≧KLSAFL holds, the program is immediately terminated, whereas if KLSAF(N) <KLSAFL holds, the present value KLSAF(N) is set to the predetermined lower limit value KLSAFL, followed by terminating the program.

As described above, when DKLSAF>0 holds, which means that the KLSAF value directly set to the KOBJ value has increased, the lean-burn feedback control is inhibited, i.e. setting of the lean-burn correction coefficient KLSAF according to the rotational speed variation amount DMSSLB is not carried out.

If DKLSAF≦0 holds at the step S34, i.e. if the KLSAF value has decreased or remains unchanged, the KLSAF feedback control process, described below, is carried out, followed by the program proceeding to the step S46.

Figure 9:
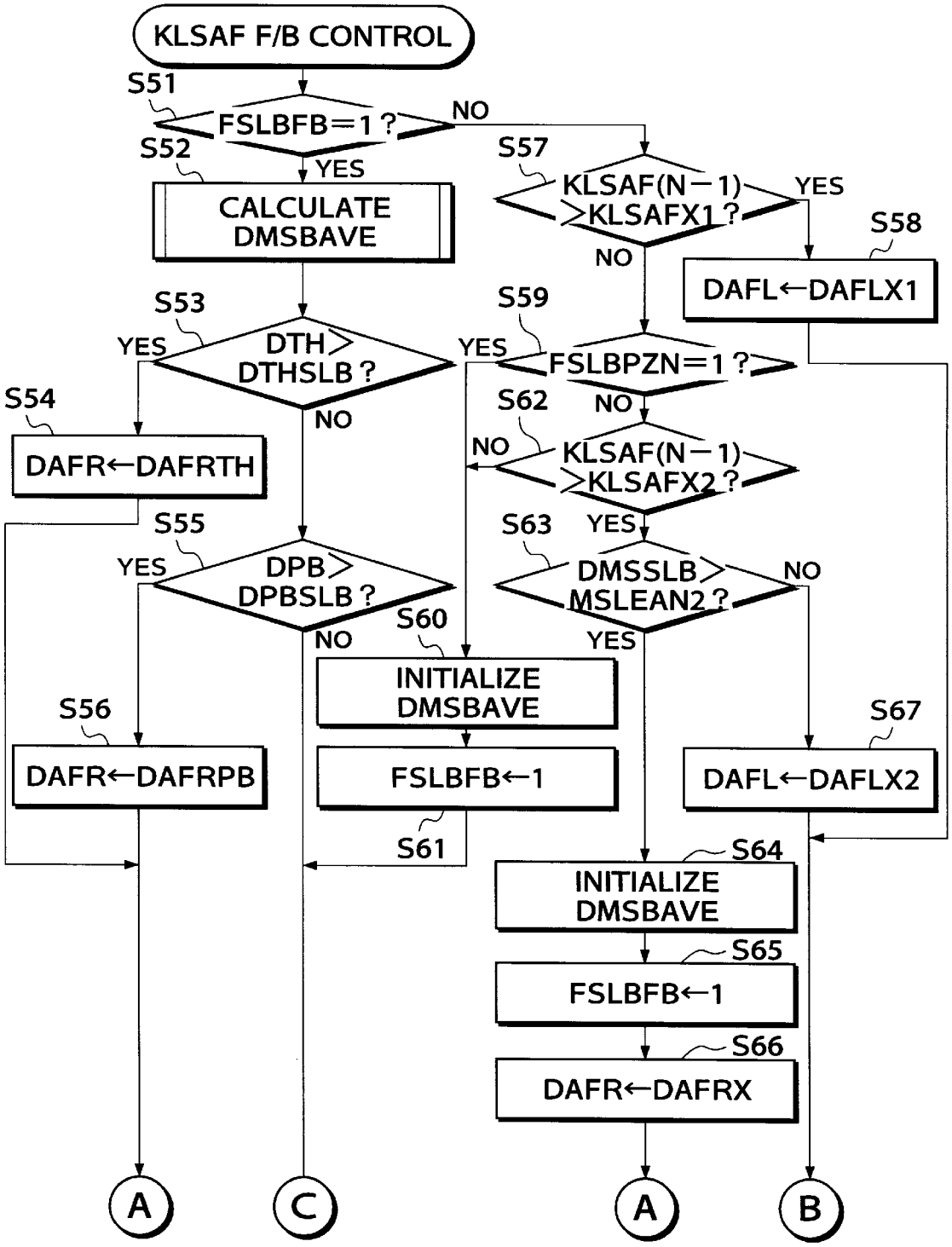
FIG. 9 is a flowchart showing a subroutine for feedback processing of the lean-burn correction coefficient KLSAF, which is executed at a step S35 in FIG. 8.
Figure 10:
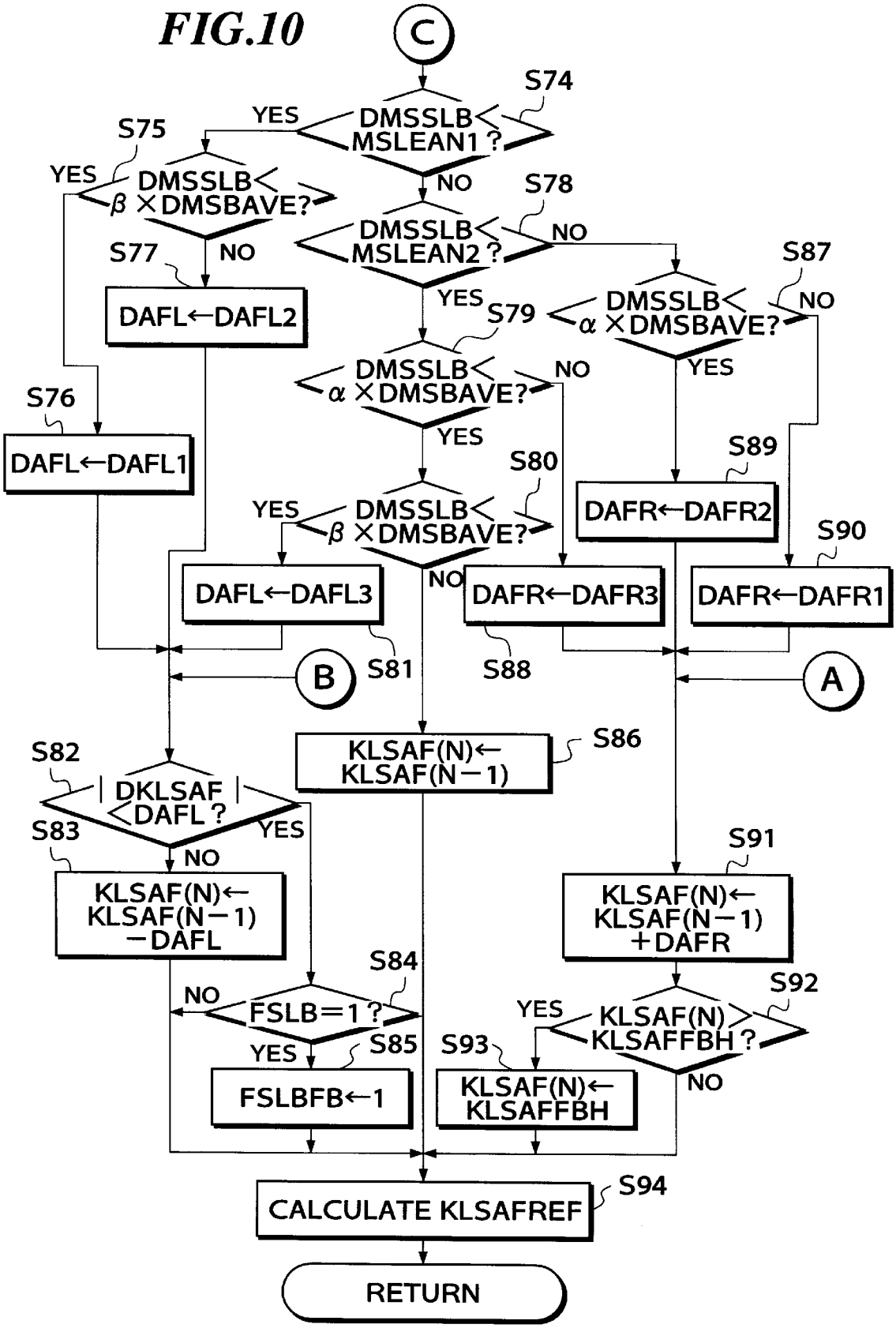
FIG. 10 is a continued part of the FIG. 9 flowchart.

FIGS. 9 and 10 show the subroutine for carrying out the KLSAF feedback control which controls the combustion state of the engine 1 to a predetermined stable combustion state. First, at a step S51 in FIG. 9, it is determined whether or not the lean feedback flag FSLBFB assumes "1". If FSLBFB=1 holds, an average value DMSBAVE of the rotational speed variation amount DMSSLB is calculated at a step S52, by the use of the following equation (8):

$$DMSBAVE = DMSCRF \times DMSSLB(N)/A + (A - DMSCRF) \times DMSBAVE(N-1)/A \tag{8}$$

where A represents a predetermined value set e.g. to 10000HEX, DMSCRF an averaging coefficient set to a value between 1 to A, and DMSBAVE(N−1) the immediately preceding value of the average value DMSBAVE.

At the following step S53, it is determined whether or not an amount of change DTH (=θ TH(N)−θ TH(N−1)) in the throttle valve opening θ TH is larger than a predetermined value DTHSLB. If DTH>DTHSLB holds, which means that the rate of change in the throttle valve opening θ TH is large (the accelerator pedal has been largely stepped on), an enriching correction coefficient DAFR is set to a predetermined value DAFRTH suitable for θ TH-increasing conditions at a step S54, followed by the program proceeding to a step S91 in FIG. 10.

At the step S91, the enriching correction coefficient DAFR is added to the immediately preceding value KLSAF (N−1) of the lean-burn correction coefficient to calculate the present value KLSAF(N) by the use of the following equation (9) to substitute for the KLSAF(N) value set to the KOBJ(N) value:

$$KLSAF(N)=KLSAF(N-1)+DAFR \tag{9}$$

Then, it is determined at a step S92 whether or not the present value KLSAF(N) thus obtained is larger than a predetermined upper limit value KLSAFFBH. If KLSAF(N) ≦KLSAFFBH holds, the program jumps to a step S94, whereas if KLSAF(N)>KLSAFFBH holds, the present value KLSAF(N) is set to the predetermined upper limit value KLSAFFBH at a step S93, followed by the program proceeding to the step S94.

At the step S94, the learned value KLSAFREF of the present value KLSAF(N) calculated as a value representative of an air-fuel ratio assumed when the variation in the rotational speed of the engine has been converged, i.e. the engine 1 is in a predetermined stable combustion state, is stored in the memory device 5*c*, followed by terminating the program. The learned value KLSAFREF is reflected on or applied during air-fuel ratio control to be carried out during the next start of the engine 1 by way of the above equation (2), whereby it is possible to accommodate manufacturing tolerances of component parts of the engine between production lots and/or deterioration or aging of the component parts.

Referring again to FIG. 9, if DTH≦DTHSLB holds at the step S53, it is determined at a step S55 whether or not an amount of change DPB (=(PBA(N)−PBA(N−1)) in the intake pipe absolute pressure PBA is larger than a predetermined value DPBSLB. If DPB>DPBSLB holds, the enriching correction coefficient DAFR is set to a predetermined value DAFRPB suitable for load-increasing conditions of the engine at a step S56, followed by the program proceeding to the step S91 (FIG. 10).

If the answer to the question of the step S55 is negative (NO), i.e. if DPB≦DPBSLB holds, the program proceeds to a step S74, wherein it is determined whether or not the rotational speed variation amount DMSSLB is smaller than a second lower threshold value MSLEAN1 (see FIG. 12B). If DMSSLB<MSLEAN1 holds, it is further determined at a step S75 whether or not the rotational speed variation amount DMSSLB is smaller than a first lower threshold value (β×DMSBAVE) (β<1.0).

If DMSSLB<(β×DMSBAVE) holds at the step S75, a leaning correction term DAFL is set to a first predetermined value DAFL1 at a step S76, whereas if DMSSLB≧(β×DMSBAVE) holds, the leaning correction term DAFL is set to a second predetermined value DAFL2 which is smaller than the first predetermined value DAFL1 at a step S77, and then the program proceeds to a step S82.

At the step S82, it is determined whether or not the absolute value of the amount of change DKLSAF in the KLSAF value calculated at the step S31 in FIG. 8 is smaller than the leaning correction term DAFL. If |DKLSAF|≧DAFL holds, the leaning correction term DAFL is subtracted from the immediately preceding value KLSAF (N−1) at a step S83 by the use of the following equation (10) to calculate the present-value KLSAF(N), followed by the program proceeding to the step S94:

$$KLSAF(N)=KLSAF(N-1)-DAFL \quad (10)$$

Thus, if |DKLSAF|≧DAFL holds, which means that the present value KLSAF(N) has decreased from the immediately preceding value KLSAF(N−1) by an amount larger than the leaning correction term DAFL, the present value KLSAF(N) is corrected such that the amount of decrease in the KLSAF(N) value becomes equal to the DAFL value set according to the rotational speed variation amount DMSSLB, thereby preventing excessive leaning of the air-fuel ratio.

If |DKLSAF|<DAFL holds at the step S82, the program proceeds to a step S84, wherein it is determined whether or not a lean flag FSLB, which, when set to "1", indicates that KLSAF(N−1)<1.0 holds, assumes "1". If FSLB=0 holds, the program jumps to the step S94, whereas if FSLB=1 holds, the lean feedback control flag FSLBFB is set to "1" at a step S85, whereby the lean-burn correction coefficient KLSAF (N) is set to the desired equivalent ratio KOBJ without subtracting the leaning correction term DAFL therefrom, and then the program proceeds to the step S94.

If the answer to the question of the step S74 is negative (NO), i.e. if DMSSLB≧MSLEAN1 holds, it is determined at a step S78 whether or not the rotational speed variation amount DMSSLB is smaller than a second upper threshold value MSLEAN2 (see FIG. 12B). If DMSSLB<MSLEAN2 holds, it is further determined at a step S79 whether or not the rotational speed variation amount DMSSLB is smaller than the first upper threshold value (α×DMSBAVE). If DMSSLB<(α×DMSBAVE) holds, it is further determined at a step S80 whether or not the rotational speed variation amount DMSSLB is smaller than the first lower threshold value (β×DMSBAVE). If the answer to the question is affirmative (YES), i.e. if DMSSLB<(β×DMSBAVE) holds, the leaning correction term DAFL is set to a third predetermined value DAFL3 (<DAFL1) at a step S81, followed by the program proceeding to the step S82.

If DMSSLB≧(β×DMSBAVE) holds at the step S80, the lean-burn correction term KLSAF is held at the immediately preceding value at a step S86, followed by the program proceeding to the step S94.

If DMSSLB≧MSLEAN2 holds at the step S78, it is further determined at a step S87 whether or not the rotational speed variation amount DMSLLB is smaller than the first upper threshold value (α×DMSBAVE). If DMSSLB≧(α×DMSBAVE) holds, the enriching correction term DAFR is set to a first predetermined value DAFRL at a step S90, whereas if DMSSLB<(α×DMSBAVE) holds, the enriching correction term DAFR is set to a second predetermined value DAFR2 which is smaller than the first predetermined value DAFR1 at a step S89, followed by the program proceeding to the step S91.

If DMSSLB≧(α×DMSBAVE) holds at the step S79, the enriching correction term DAFR is set to a third predetermined value DAFR3 (<DAFR1) at a step S88, followed by the program proceeding to the step S91.

Thus, when the rotational speed variation amount DMSSLB is large, the enriching correction term DAFR is set to a larger value as the rotational speed variation amount DMSSLB is larger, thereby preventing the combustion state of the engine from becoming still worse.

Referring again to FIG. 9, if FSLBFB=0 holds at the step S51, it is determined at a step S57 whether or not the immediately preceding value KLSAF(N−1) of the lean-burn correction coefficient is larger than a predetermined value KLSAFX1. If KLSAF(N−1)>KLSAFX1 holds, the leaning correction term DAFL is set to a fourth predetermined value DAFLX1 at a step S58, followed by the program proceeding to the step S82.

If KLSAF(N−1)≦KLSAFXL holds at the step S57, it is determined at a step S59 whether or not a high load flag FSLBPZN, which, when set to "1", indicates that the engine is in a predetermined high-load operating condition, assumes "1". If FSLBPZN=0 holds, it is determined at a step S62 whether or not the immediately preceding value KLSAF (N−1) is larger than a predetermined value KLSAFX2 (<KLSAFX1). If FSLBPZN=1 holds at the step S59, or if KLSAF(N−1)<KLSAFX2 holds at the step S62, the program proceeds to a step S60, wherein the average value DMSBAVE of the rotational speed variation amount DMSSLB is initialized, and at the same time the lean feedback control flag FSLBFB is set to "1" at a step S61, followed by the program proceeding to the step S74. The initialization of the average value DMSBAVE is carried out by setting the same to the present value DMSSLB(N) of the rotational speed variation amount.

If KLSAF(N−1)>KLSAFX2 holds at the step S62, it is determined at a step S63 whether or not the rotational speed variation amount DMSSLB is larger than the second upper threshold value MSLEAN2. If DMSSLB<MSLEAN2 holds, the leaning correction term DAFL is set to a fifth predetermined value DAFLX2 at a step S67, followed by the program proceeding to the step S82.

If DMSLLB>MSLEAN2 holds at the step S63, which means that the combustion state of the engine has become worse or unstable, initialization of the average value DMSBAVE is executed and at the same time the lean feedback control flag FSLBFB is set to "1" at steps S64 and S65, respectively, similarly to the steps S60 and S61. Further, the enriching correction term DAFR is set to a fourth predetermined value DAFRX at a step S66, followed by the program proceeding to the step S91.

Figure 11A:
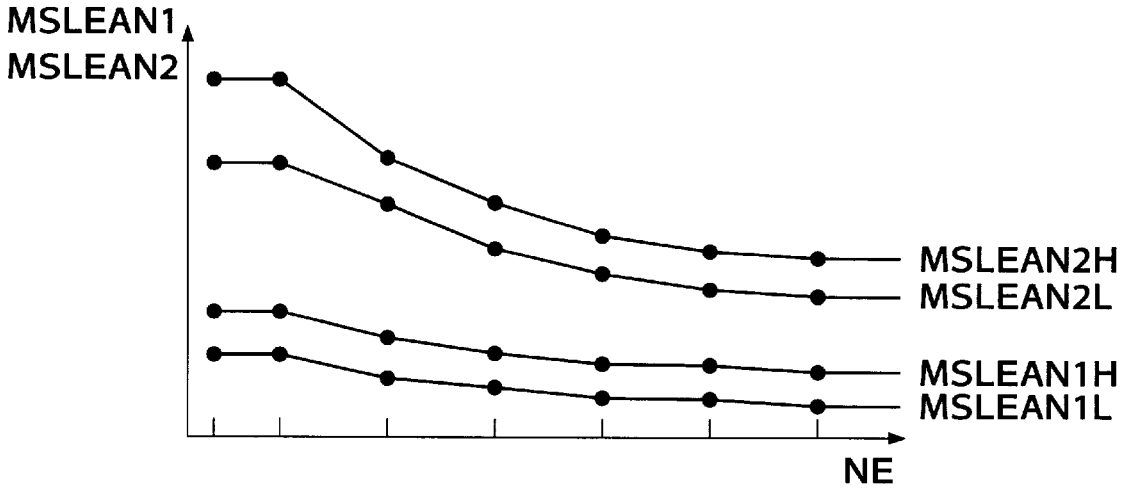
Figure 11B:
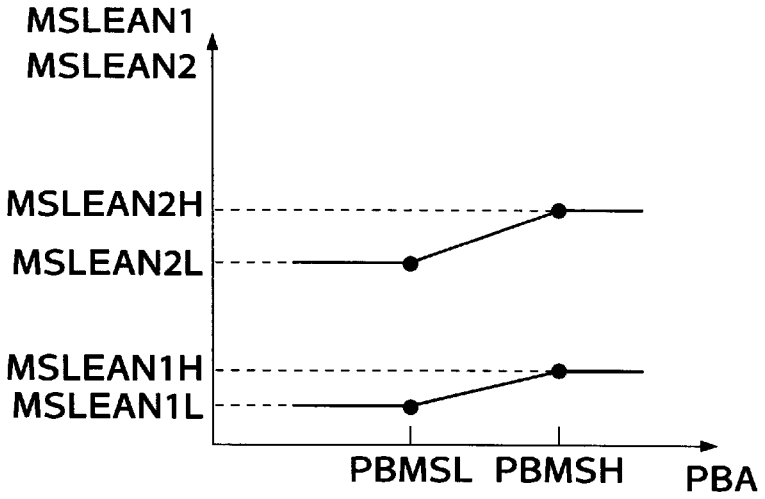

The second lower threshold value MSLEAN1 and the second upper threshold value MSLEAN2 employed in the FIGS. 9 and 10 process are set in the following manner by executing a routine, not shown:

First, a table shown in FIG. 11A is retrieved according to the engine rotational speed NE to determine upper limit values MSLEAN1H, MSLEAN2H and lower limit values MSLEAN1L, MSLEAN2L of the threshold values MSLEAN1, MSLEAN2. Then, as shown in FIG. 11B, if the intake pipe absolute pressure PBA is equal to or higher than an upper limit value PBMSH, the upper limit values MSLEAN1H and MSLEAN2H are employed as the threshold values MSLEAN1 and MSLEAN2, respectively, whereas if the intake pipe absolute pressure PBA is equal to or lower than a lower limit value PBMSL, the lower limit values MSLEAN1L, MSLEAN2L are employed as the same. If PBMSL<PBA<PBMSH holds, the MSLEAN1 value and the MSLEAN2 value are determined by interpolation.

Further, as shown in Table 1 below, depending on whether the vehicle on which the engine is installed is an MT (manual transmission) type or an AT (automatic transmission) type, as well as on the gear ratio of the transmission, correction coefficients KMSGRiM(I=3, 4, 5) and KMSGRjA (j=2, 3, 4) are determined, and the values determined based on the FIG. 11A and 11B tables are multiplied by these correction coefficients to determine final values of the threshold values MSLEAN1 and MSLEAN2.

TABLE 1

| | 3rd Speed (AT: 2nd Speed) | 4th Speed (AT: 3rd Speed) | 5th Speed (AT: 4th Speed) |
|---|---|---|---|
| MT | KMSGR3M | KMSGR4M | KMSGR5M |
| AT (CVT) | KMSGR2A | KMSGR3A | KMSGR4A |

These correction coefficient values are set such that KMSGR3M<KMSGR4M<KMSGR5M, and KMSGR2A<KMSGR3A<KMSGR4A hold. "CVT" in Table 1 represents a variable speed transmission, and when the gear ratio of the variable speed transmission assumes values corresponding to those of the second speed, the third speed, and the fourth speed of the AT, the values KMSGR2A, KMSGR3A, and KMSGR4A are selected, respectively.

The following is a summary of the manner of setting the first to third predetermined values DAFRL to 3 and DAFL1 to 3 of the correction terms DAFR and DAFL for the lean-burn correction coefficient KLSAF according to the rotational speed variation amount DMSSLB by the routine shown in FIGS. 9 and 10:

1) If DMSSLB ≧MSLEAN2 and DMSSLB ≧α×DMSBAVE, then DAFR=DAFR1;
2) If α×DMSBAVE>DMSSLB ≧MSLEAN2, then DAFR=DAFR2 (<DAFR1);
3) If MSLEAN2>DMSSLB ≧α×DMSBAVE, then DAFR=DAFR3 (<DAFR1);
4) If DMSSLB<MSLEAN2 and DMSSLB 21 α×DMSBAVE and DMSSLB2 MSLEAN1 and DMSSLB ≧α×DMSBAVE, then KLSAF(N)=KLSAF (N−1), i.e. the lean-burn correction coefficient is held at the immediately preceding value;
5) If β×DMSBAVE>DMSSLB ≧MSLEAN1, then DAFL=DAFL3 (<DFL1);
6) If MSLEAN1>DMSSLB ≧β×DMSBAVE, then DAFL=DAFL2 (<DFL1); and
7) If DMSSLB<MSLEAN1 and DMSSLB<β×DMSBAVE, then DAFL=DAFL1.

That is, when the DMSSLB value is equal to or larger than the upper threshold value MSLEAN2 or α×DMSBAVE, the enriching correction term DAFR is set to a larger value as the DMSSLB value increases, whereas when the DMSSLB value is smaller than the lower threshold value MSLEAN1 or β×DMSBAVE, the leaning correction term DAFL is set to a larger value as the DMSSLB value decreases. When the DMSSLB value falls between the upper threshold value and the lower threshold value, the lean-burn correction coefficient KLSAF is held at the immediately preceding value.

According to the present embodiment, the after-start lean-burn control is carried out by the FIGS. 4 to 6 processes over the predetermined time period TMKLSAF from the start of the engine 1, to thereby improve exhaust emission characteristics of the engine 1, while when the combustion state of the engine 1 is unstable, the after-start lean-burn control is inhibited to prevent the driveability of the engine 1 from being degraded. Therefore, e.g. even when a fuel having a low volatility is used, it is not required to set the lean-burn correction coefficient to a value considerably richer than the lean limit, which makes it possible to improve exhaust emission characteristics of the engine 1, such as reduced emission of HC, to a satisfactory degree as intended by the lean burn control.

Figure 12A:
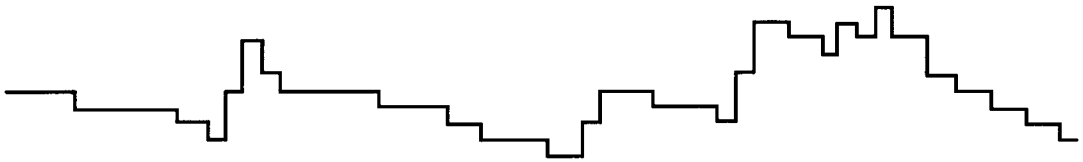
Figure 12B:
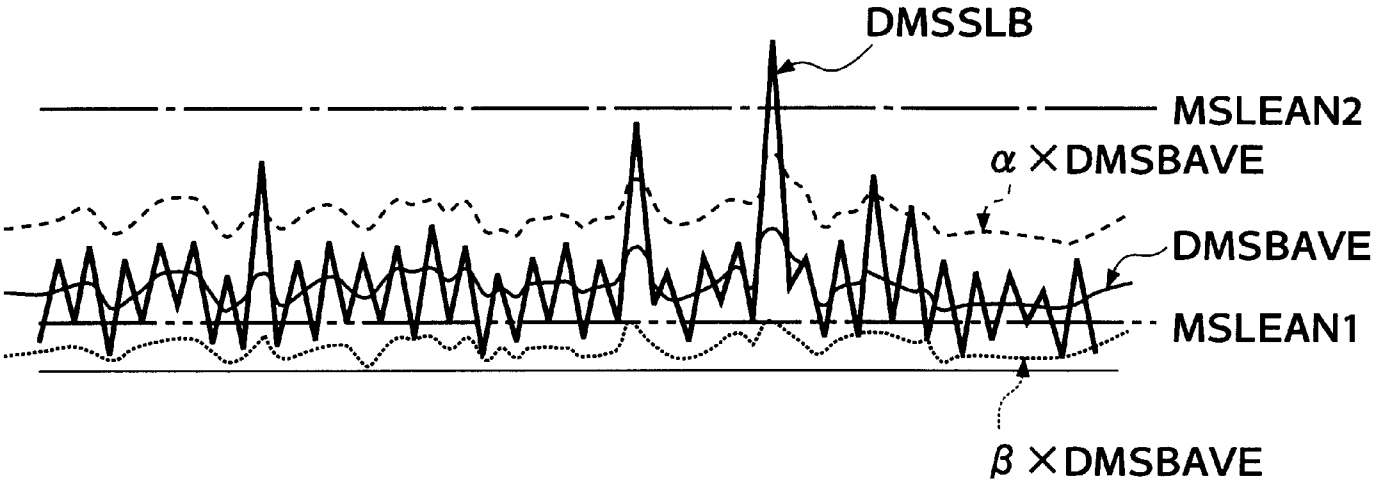

Further, according to the present embodiment, as shown in FIG. 12, the enriching correction coefficient DAFR and the leaning correction coefficient DAFL for the lean-burn correction coefficient KLSAF are determined according to the rotational speed variation amount DMSSLB by executing the FIGS. 9 and 10 process. As a result, it is possible to achieve excellent exhaust emission characteristics of the engine and enhanced fuel economy without degrading the driveability of the engine. Moreover, according to the present embodiment, the rotational speed variation amount DMSSLB is compared with the first threshold values (α×DMSBAVE) and (β×DMSBAVE) which are calculated based on the average value DMSBAVE of the rotational speed variation amount DMSSLB, and depending on results of the comparison, the lean-burn correction coefficient KLSAF is set. As a result, it is possible to perform the optimum lean-burn feedback control, to thereby achieve the optimum exhaust emission characteristics of the engine and the optimum fuel economy without degrading the driveability of the engine, irrespective of manufacturing tolerances of component parts of the engine between production lots and/or the degree of deterioration or aging of the component parts.

Still further, according to the present embodiment, the correction terms DAFR, DAFL for the lean-burn correction coefficient KLSAF are determined by the use of the second threshold values MSLEAN1, MSLEAN2, as well. This makes it possible to attain more accurate and fine lean-burn feedback control. Moreover, the second threshold values MSLEAN1, MSLEAN2 are determined based on the engine rotational speed NE, the intake pipe absolute pressure PBA, and the gear ratio (shift position) of the transmission of the vehicle, and at same time the misfire-determining threshold value MSLMT is set to a value larger than the second upper threshold value MSLEAN2. This makes it possible to attain the optimum lean-burn feedback control suitable for operating conditions of the vehicle and/or the engine Further, the learned value KLSAFREF of the KLSAF(N) value calculated when the rotational speed variation amount DMSSLB has been converged is stored in the memory device 5*c* during execution of the FIGS. 9 and 10 process, which is reflected on air-fuel ratio control carried out during the next start of the engine 1, whereby it is possible to perform the lean burn control in a manner accommodating differences in the combustion state of the engine due to manufacturing variations of component parts thereof between production lots and/or deterioration or aging of the component parts to thereby achieve excellent startability of the engine 1 and enhanced exhaust emission characteristics of the same.

Although in the above embodiment, the time period over which the after-start lean-burn control is carried out is set to the predetermined time period TMKLSAF at the step S504 in FIG. 5, this is not limitative, but it may be determined whether the three-way catalyst 15 is activated, and the after-start lean-burn control may be continued until the three-way catalyst 15 has been activated, to obtain the same effects as obtained by the above embodiment. Whether or not the three-way catalyst 15 is activated can be determined e.g. by arranging an exhaust gas concentration-detecting sensor at a location downstream of the three-way catalyst 15, and determining that the catalyst is activated when an output variation of the sensor is within a predetermined range (Japanese Laid-Open Patent Publication (Kokai) No. 6-167210). The activation of the catalyst can be also determined by detecting the temperature of the three-way catalyst 15 and determining that the catalyst 15 is activated when the detected temperature exceeds a predetermined value. Further, it is also possible to determine the activation of the three-way catalyst 15 from a function of engine load and time of engine operation under the load. Any of these methods may be employed.

What is claimed is:

1. A fuel supply control system for an internal combustion engine installed on an automotive vehicle, said engine having an exhaust system, and an exhaust gas-purifying device arranged in said exhaust system, the fuel supply control system comprising:

start-detecting means for detecting a start of said engine;

combustion stability-detecting means for detecting a combustion stability of said engine; and leaning means for leaning an air-fuel ratio of a mixture supplied to said engine over a predetermined time period from said start of said engine, depending on an output from said combustion stability-detecting means.

2. A fuel supply control system according to claim 1, wherein said predetermined time period is a time period which elapses before said exhaust gas-purifying device is activated.

3. A fuel supply control system according to claim 1 or 2, wherein said leaning means is inhibited from operating when said combustion stability detected by said combustion stability-detecting means indicates a combustion state in which a misfire occurs in said engine.

4. A fuel supply control system according to claim 1 or 2, wherein said leaning means controls said air-fuel ratio of said mixture supplied to said engine in a manner such that said combustion stability detected by said combustion stability-detecting means becomes a predetermined combustion stability.

5. A fuel supply control system according to claim 1 or 2, wherein said leaning means stores a value of said air-fuel ratio of said mixture supplied to said engine, which is assumed when said combustion stability of said engine is converged to said predetermined combustion stability, and controls said air-fuel ratio of said mixture supplied to said engine based on said stored value of said air-fuel ratio when said engine is started.

6. A fuel supply control system according to claim 1, wherein said combustion stability-detecting means detects an amount of variation in rotational speed of said engine, and detects said combustion stability of said engine based on the detected amount of variation.

7. A fuel supply control system according to claim 1, including means for detecting a temperature of said engine, and wherein when said temperature of said engine is not within a predetermined range, said leaning means is inhibited from operating.

8. A fuel supply control system according to claim 1, including operating condition-detecting means for detecting operating conditions of at least one of said engine and said automotive vehicle, said combustion stability-detecting means detecting a parameter indicative of a combustion state of said engine, wherein said leaning means comprises:

first combustion state reference value-calculating means for calculating a first combustion state reference value based on said parameter indicative of said combustion state of said engine detected by said combustion state-detecting means;

second combustion state reference value-calculating means for calculating a second combustion state reference value depending on said operating conditions of said at least one of said engine and said automotive vehicle detected by said operating condition-detecting means;

comparison means for comparing said detected parameter indicative of said combustion state of said engine with said first combustion state reference value and said second combustion state reference value; and correction means for correcting said air-fuel ratio of said mixture supplied to said engine, based on results of said comparison by said comparison means.

9. A fuel supply control system according to claim 8, wherein said parameter indicative of said combustion state of said engine is an amount of variation in rotational speed of said engine.

10. A fuel supply control system according to claim 8, wherein said first combustion state reference value is set based on an average value of said parameter indicative of said combustion state of said engine.

11. A fuel supply control system according to claim 8, wherein said first combustion state reference value comprises a combustion-unstable side reference value set to such a value that when a degree of unstability of said combustion state of said engine indicated by said detected parameter exceeds said combustion-unstable side reference value, said combustion state of said engine can become unstable, and a combustion-stable side reference value set to a value higher in stability than said combustion-unstable side reference value.

12. A fuel supply control system according to claim 11, wherein said correction means corrects said air-fuel ratio of said mixture supplied to said engine in such a direction that said combustion state of said engine becomes stabilized, when said degree of unstability of said combustion state of said engine indicated by said detected parameter exceeds said combustion-unstable side reference value of said first combustion state reference value, while said correction means corrects said air-fuel ratio of said mixture supplied to said engine in such a direction that said engine has improved fuel economy, when said degree of unstability of said combustion state of said engine indicated by said detected parameter is below said combustion-stable side reference value of said first combustion state reference value.

13. A fuel supply control system according to claim 11, wherein said second combustion state reference value comprises a combustion-unstable side reference value set to such a value that when a degree of unstability of said combustion state of said engine indicated by said detected parameter exceeds said combustion-unstable side reference value of said second combustion state reference value, said combustion state of said engine can become unstable, and a combustion-stable side reference value set to value higher in stability than said combustion-unstable side reference value of said second combustion state reference value.

14. A fuel supply control system according to claim 12, wherein said second combustion state reference value comprises a combustion-unstable side reference value set to such a value that when a degree of unstability of said combustion state of said engine indicated by said detected parameter exceeds said combustion-unstable side reference value of said second combustion state reference value, said combustion state of said engine can become unstable, and a combustion-stable side reference value set to a value higher in stability than said combustion-unstable side reference value of said second combustion state reference value, and wherein when said degree of unstability of said combustion state of said engine indicated by said detected parameter exceeds said combustion-unstable side reference value of said second combustion state reference value, said correction means corrects said air-fuel ratio of said mixture supplied to said engine by the use of a first correction amount in such a direction that said combustion state of said engine becomes stabilized when said degree of unstability of said combustion state of said engine indicated by said detected parameter exceeds said combustion-unstable side reference value of said first combustion state reference value, while said correction means corrects said air-fuel ratio of said mixture supplied to said engine by the use of a second correction amount smaller than said first correction amount in such a direction that said combustion state of said engine becomes stabilized when said degree of unstability of said combustion state of said engine indicated by said detected parameter is below said combustion-unstable side reference value of said first combustion state reference value.

15. A fuel supply control system according to claim 12, wherein said second combustion state reference value comprises a combustion-unstable side reference value set to such a value that when a degree of unstability of said combustion state of said engine indicated by said detected parameter exceeds said combustion-unstable side reference value of said second combustion state reference value, said combustion state of said engine can become unstable, and a combustion-stable side reference value set to a value higher in stability than said combustion-unstable side reference value of said second combustion state reference value, and wherein when said degree of unstability of said combustion state of said engine indicated by said detected parameter is below said combustion-stable side reference value of said second combustion state reference value, said correction means corrects said air-fuel ratio of said mixture supplied to said engine by the use of a first correction amount in such a direction that said engine has improved fuel economy when said degree of unstability of said combustion state of said engine indicated by said detected parameter exceeds said combustion-stable side reference value of said first combustion state reference value, while said correction means corrects said air-fuel ratio of said mixture supplied to said engine by the use of a second correction amount larger than said first correction amount in such a direction that said engine has improved fuel economy when said degree of unstability of said combustion state of said engine indicated by said detected parameter is below said combustion-stable side reference value of said first combustion state reference value.

* * * * *